US007020999B1

(12) United States Patent
Stouffer et al.

(10) Patent No.: US 7,020,999 B1
(45) Date of Patent: Apr. 4, 2006

(54) REVERSIBLE HANGING PLANT SUPPORT

(75) Inventors: John D. Stouffer, Granger, IN (US); Terry Ray Rock, Benton Harbor, MI (US)

(73) Assignee: Stouffer Technologies, Inc., South Bend, IN (US)

( * ) Notice: Subject to any disclaimer, the term of this patent is extended or adjusted under 35 U.S.C. 154(b) by 117 days.

(21) Appl. No.: 10/710,036

(22) Filed: Jun. 14, 2004

(51) Int. Cl.
*A01G 9/02* (2006.01)

(52) U.S. Cl. ..... 47/67

(58) Field of Classification Search ..... 47/67, 47/48.5; D8/373; 185/40 R; 335/229
See application file for complete search history.

(56) References Cited

U.S. PATENT DOCUMENTS 3,604,536 A * 9/1971 Dinnerstein ..... 185/40 R
4,216,619 A 8/1980 Espy
4,446,653 A 5/1984 Morgan
4,574,521 A * 3/1986 Landy ..... 47/67
5,315,794 A 5/1994 Pearson
5,546,698 A * 8/1996 Rock ..... 47/67
6,230,440 B1 * 5/2001 Deutsch ..... 47/67

* cited by examiner

*Primary Examiner*—Francis T. Palo

(57) ABSTRACT

A system for supporting a household plant includes an electric circuit for selectively moving the plant having a battery and a direct current motor for moving the plant. The motor control is by a first controllable switching device to connect the battery to the motor with a first polarity to cause the plant to move in a first direction, or a second controllable switching device to connect the battery to the motor with a second polarity opposite the first polarity to cause the plant to move in a second direction. A controller selectively enables either the first or second switching devices while leaving the other disabled and in conjunction with a light sensing device and analog comparison circuit precludes actuation of either switching device if inadequate growth promoting light is sensed.

6 Claims, 3 Drawing Sheets

REVERSIBLE HANGING PLANT SUPPORT

BACKGROUND OF INVENTION

The present invention relates to a device for supporting and rotating a hanging plant and more particularly to such a device to rotate the hanging plant on a uniform growth promoting schedule as a function of the presence of adequate growth promoting light.

It is well recognized that a plant will grow in the direction of sunlight and may eventually become lopsided if the plant is not rotated on a consistent basis. This is especially true in situations where the plant is hung adjacent to a window and only receives sunlight in one direction. Several attempts have been made to promote uniform plant growth as disclosed in the following patents:

U.S. Pat. No. 4,216,619 discloses a device for rotating a plant as moisture evaporates from the container holding the plant. Rotational motion on the plant is accomplished through the use of a spring that is linearly distorted by the weight of gravity. A spiral motion conversion mechanism connected to the spring converts the linear distortion into rotational motion;

U.S. Pat. No. 4,446,653 discloses a device for supporting and rotating a hanging plant which is responsive to the addition and evaporation of water in the plant holder. The device consists primarily of a cord attached to a fixed hook at one end, and a plant at the other end. The cord extends in length and winds in one direction in response to an increase in the weight of the plant due to the addition of water. Conversely, the cord retracts and winds in the opposite direction in response to a decrease in the weight of the plant due to the evaporation of the water;

U.S. Pat. No. 5,315,794 discloses a device for rotating a hanging plant. Counteracting coaxial tension springs rotate the plant in one direction when the plant is watered and then back in the other direction as the water evaporated from the plant. In each case, the same principles of operation are employed; that is, the use of gravitational force on the plant, responsive to increases and decreases of the weight of the plant. These devices generally consist of springs or cords which, when extended or retracted, impart a rotational motion on the plant itself. It should be noted, however, that the amount of rotational motion on the plant ultimately depends on the amount of water present in the plant; and U.S. Pat. No. 5,546,698 discloses a system to obviate the dependence on the amount of water present in the plant by automatically rotating a hanging plant at predetermined intervals. This system includes an apparatus for support and rotating a hanging plant with a housing having an upper hook fixedly attached to a top surface thereon and a lower hook that extends from a bottom surface of the housing for hanging and supporting a plant. There is a light sensing mechanism, disposed on the outside of the housing for detecting the amount of ambient light incident upon the housing along with a rotary mechanism, disposed within the housing, for periodically rotating the lower hook relative to the upper hook whenever the amount of ambient light detected by the light sensing mechanism exceeds a threshold value. The rotary mechanism further includes a DC motor within the housing, a reduction gearing assembly connected to an output shaft of the motor, and a vertically disposed shaft, rotatingly coupled to the reduction gear assembly and connected to the lower hook. In addition, a first timing mechanism responsive to the light sensing mechanism determines when the DC motor is to be energized, while a second timing mechanism, also responsive to the light sensing mechanism. controls the duration of time that the DC motor is energized. This meritorious improvement on prior plant rotating devices still possessed a few drawbacks. The power supply, such as a single battery, functioned both to drive the motor and as a current source for the light sensor and other electronics some of which was continuously energized. This resulted in an undesirably short battery life. Moreover, plant rotation was limited to a single rotational sense. A need, therefore, remains for a device that will support an ordinary houseplant while automatically rotating it at pre-selected intervals in order to promote even growth of the plant.

Plants tend to grow toward the sun due, at least in part, to the phenomenon that the portion of the plant stem facing the light source experiences a greater growth rate than does the stem portion which faces away from the light source. A plant rotating device such as the aforementioned U.S. Pat. No. 5,546,698 patent continually rotates in one sense and the plant follows the light often forming a corkscrew or helical pattern. Such a growth pattern is interesting, but generally undesirable. Depending on the type of plant, the helix may descend from the plant pot or may grow upward eventually wrapping itself about the support. Unfortunately, the continual rotation requires constant energy resulting in a corresponding battery drain such that in order to function in a desired manner a battery may need to be changed on a regular basis and for most plants it is desirable to avoid the helical growth pattern sometimes found with apparatus of the prior art.

SUMMARY OF INVENTION

The present invention provides solutions to the above problems by inducing a asleep mode to minimize battery drain, and by selectively reversing the rotational direction of plant movement.

The invention comprises, in one form thereof, a method of suspending a plant to distribute light from a source around the plant to ensure the application of uniform growth promoting light about the entire periphery of the plant by suspending a motor driven plant hanger from a fixed elevated member and suspending the plant beneath the plant hanger. A light sensor senses the intensity of growth promoting light and the angular position of the plant relative to the plant hanger is periodically incremented. Periodic incrementation is suspended when the sensed light intensity falls below a predetermined threshold and resumed when the sensed light intensity exceeds the predetermined threshold. A sum of the angular increments is maintained and the angular sense of the periodic increments reversed when the sum of the angular increments reaches a predetermined value. Summing is commenced anew each time the angular sense of the periodic increments is reversed. Sensing for the presence of adequate light may include periodically enabling a light intensity comparison circuit for a short time interval, and disabling the light intensity comparison circuit for a longer time interval between an enabled time interval and a successive enabled time interval, so that the light intensity comparison circuit spends most of the time in a current conserving sleep mode.

BRIEF DESCRIPTION OF DRAWINGS

Corresponding reference characters indicate corresponding parts throughout the several drawing views.

DETAILED DESCRIPTION

Figure 1:
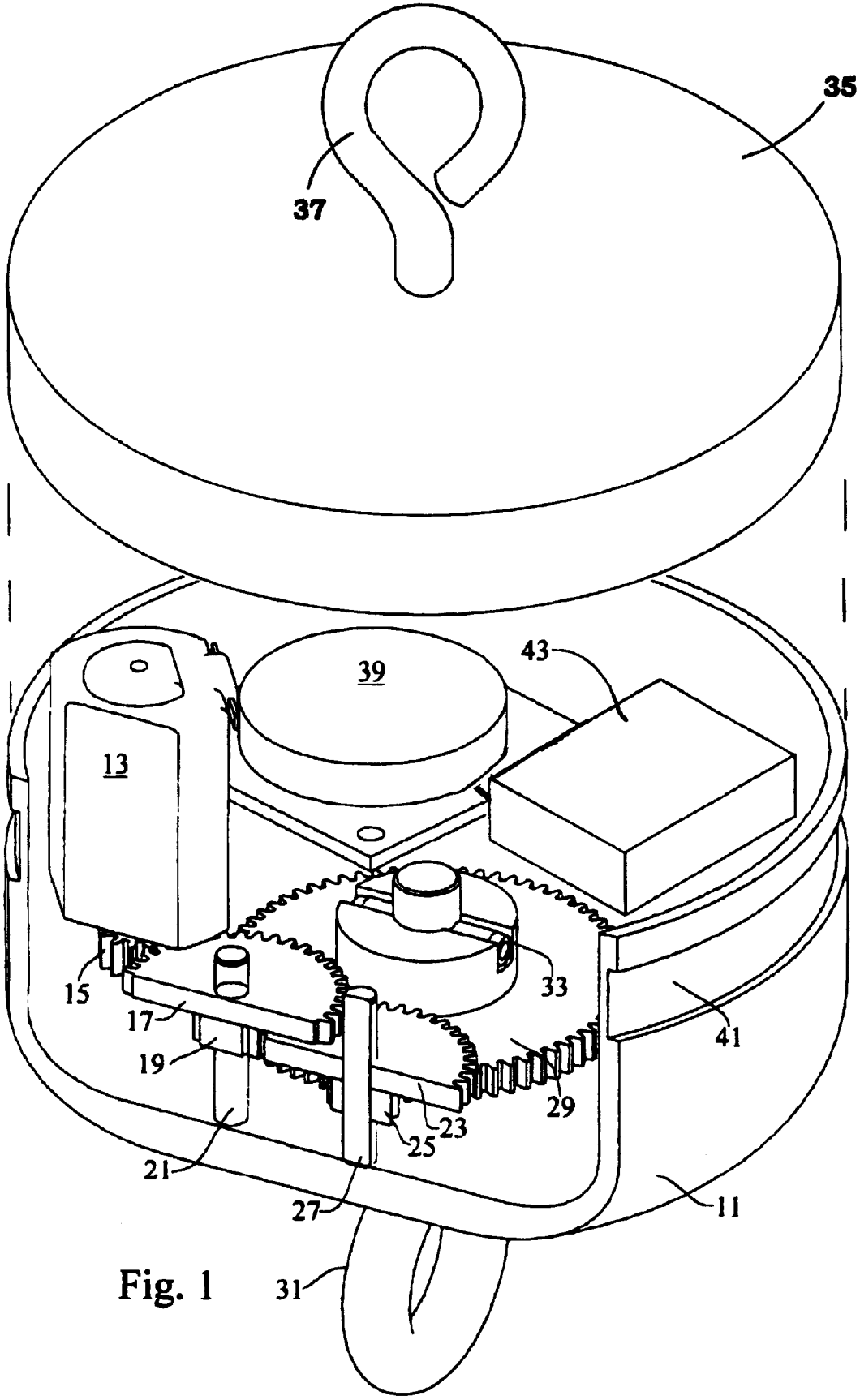
FIG. 1 is a partially broken away isometric view of a reversible hanging plant support according to the invention in one form.

Referring now to the drawings and particularly to FIG. 1, there is shown a plant rotating mechanism having a housing 11, that is partially cut away to reveal the internal components, that includes a direct current motor 13 with an armature shaft supporting a gear 15. Gear 15 drivingly engages gear 17 that is fixed to a smaller gear 19 to rotate together about the axis of a common shaft 21. Gear 19 drivingly engages gear 23 that is fixed to a smaller gear 25 to rotate together about the axis of a common shaft 27. Finally, gear 25 drivingly engages gear 29 that is fixed by a transverse pin 33 to the shaft of a downwardly extending hook or eye 31 designed to receive the hanging plant. Thus, the gears 15, 17, 19, 23, 25 and 29 comprise a speed reduction gear train. A ball bearing arrangement is provided beneath the gear 29 for supporting the weight of a suspended plant if desired. A cover portion 35 for the housing 11 includes an upwardly extending hook 37 designed to suspend the plant and plant rotating device from a stationary support. The cover portion 35 may be joined to the housing 11 by any suitable technique. For example, the cover portion 35 may include an inner rim or several pawls for engaging the groove 41 of the housing. The circuitry of FIG. 2 is located within housing 39, however batteries may be located elsewhere within housing 11 to facilitate replacement.

Figure 2:
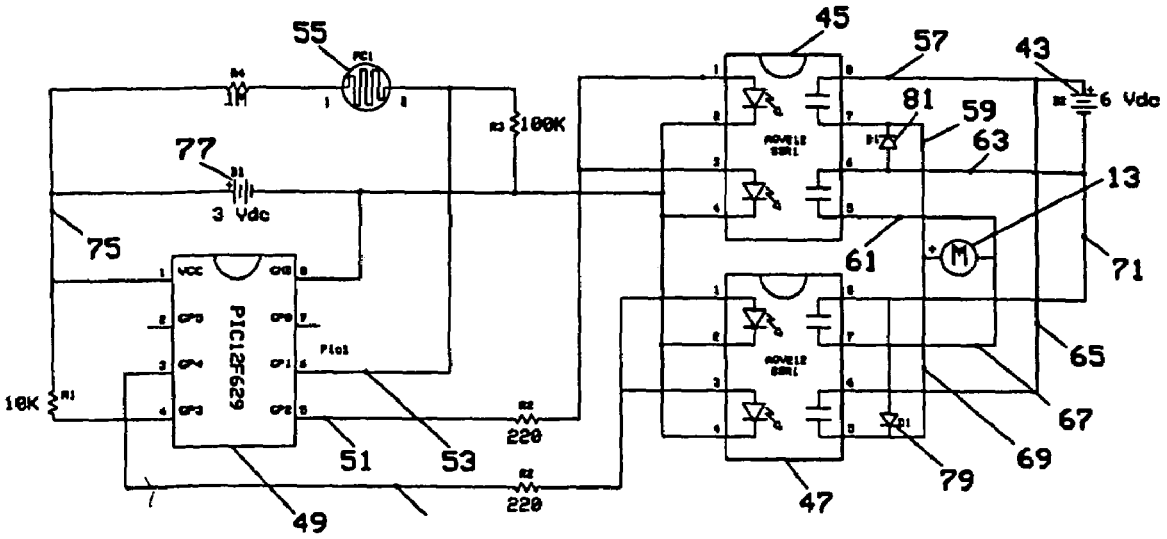
FIG. 2 is a schematic illustration of an electric circuit for selectively moving a plant.

An electric circuit for selectively moving a system supporting a household plant is illustrated in FIG. 2, and includes the direct current motor 13 of FIG. 1 and a battery 43 for energizing the motor to move the plant. Control circuitry includes a first controllable switching device such as an optically isolated solid state relay 45. Relay 45 may be enabled to connect the battery 43 to the motor 13 with a first polarity to cause the plant to move in a first direction. When relay 45 is enabled, conventional current flow is from the positive battery terminal by way of line 57, the upper closed contacts of relay 45 and line 59 to the left motor terminal. Flow continues from the right motor terminal by way of line 61, the lower closed relay contacts and line 63 to the negative battery terminal. Another optically isolated solid state relay 47 functions as a second controllable switching device and is enableable to connect the battery 43 to the motor 13 with a second polarity opposite the first polarity to cause the motor to rotate and the plant to move in a second direction. This time, conventional current flow is from the positive battery terminal by way of line 65, the lower closed contacts of relay 47 and line 67 to the right motor terminal. Flow continues from the left motor terminal by way of line 69, the lower closed relay contacts and line 71 to the negative battery terminal. Thus, when relay 45 is enabled, the motor receives battery current in one direction, but when relay 47 is enabled, the current flow through the motor is in the opposite direction and the motor rotates in an opposite sense. Of course, both relays can not be enabled at the same time, because a short circuit would result. The circuit of FIG. 2 further includes a controller 49 for selectively providing an enabling signal on line 51 to the switching device 45 while leaving the switching device 47 disabled. The controller 49 may comprise a PIC12F629 microchip and the relays may be AQV212 Digikey 255-1148-ND units. The controller 49 is capable of subsequently removing the signal from line 51 disabling the switching device 45 and providing instead an enabling signal by way of line 73 to the switching device 47 while leaving the switching device 45 in a disabled state.

FIG. 2 additionally shows a light sensing device 55, such as a cadmium photo cell, which is coupled to the controller 49 and functions to preclude the enablement of either switching device 45 or 47 so long as inadequate growth promoting light is sensed. The cadmium photocell may be a Digikey PDV-P9007-ND unit. The controller includes an analog comparison circuit coupled to the light-sensing device 55 by lines 53 and 75. A predetermined threshold level may be programmed into the controller and that level compared to the sensor 55 output for determining the presence of adequate growth promoting light. A second battery 77 supplies the energy needs of the controller 49, light sensor 55 and relays 45 and 47. The controller includes a timer for periodically enabling the light intensity comparison circuit for a short time interval and disabling the comparison circuit for a longer time interval between an enabled time interval and a subsequent enabled time interval, whereby the comparison circuit spends most of the time in a second battery longevity increasing sleep mode. The controller 49 also includes a counter for recording the number of times a switching device is enabled and, upon reaching a predetermined count, initializable to then record the number of times the other switching device is enabled. This may be accomplished by loading a prescribed number of angular incrementations into the counter and decrementing by one upon each such angular incrementation.

The controller 49 is an 8 Bit Flash Micro Controller (PIC12F629) from Microchip having several input/output capabilities with one being an analog comparator. The system timing is controlled by an internal R/C circuit which reduces external parts. The motor is controlled by optically isolated solid state relays 45 and 47. The light level is detected by a single cadmium photo cell 55. The microchip is powered by a 3 volt button battery 77 and the motor 13 is powered by a separate set of four triple AAA batteries indicated at 43. Diodes 79 and 81 are included on the motor side of the relay contacts to protect the solid state electronics against reverse voltage spikes. The diodes provide a current path so that when the relay contacts open, an instantaneous reduction in armature current flow is avoided.

Figure 3:
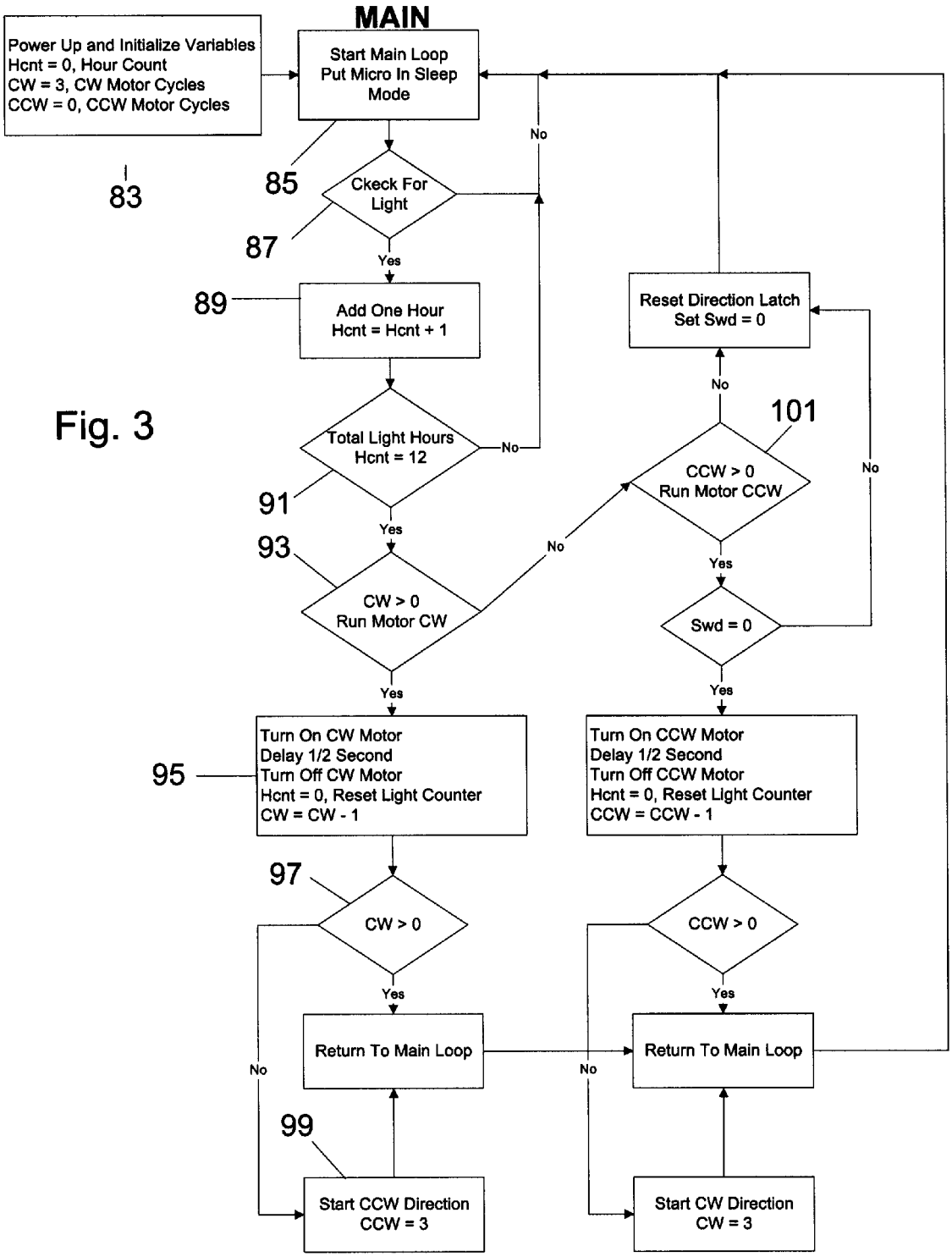
FIG. 3 is a flow chart describing the operation of the circuit of FIG. 2.

The function of the microchip controller is to monitor the light source and keep track of the hours the plant is exposed. The controller includes three counters, a counter for the number of hours growth promoting light is sensed (Hcnt), a counter for the number of times the motor has been enabled in a clockwise sense (CW), and a counter for the number of times the motor has been enabled in a counterclockwise sense (CCW). When the total hours reach a set point, the motor is pulsed either clockwise or counterclockwise for a preset time such that a minimum rotation of 15 degrees occurs and preferably from 45 to 90 degrees of rotation occurs depending on the weight of the plant and battery voltage. Changing motor direction helps with a more random spread of light. When battery power is first applied, the program in the controller initializes the variables and counters to be used as indicated at 83 in FIG. 3. The controller is then put into a sleep mode for one hour as shown at 85. This is to minimize power draw and extend battery life. After one hour has elapsed, the controller will wake and inspect the voltage level on the analog comparator input that is connected to the cadmium photocell 55 as indicated at 87. The amount of light determines the voltage level for the input and is compared to a fixed reference voltage. If the light indicative voltage is above the reference voltage level (a Ayes≅at 87), the hour counter variable will be incremented by one as shown at 89. This indicates one hour of light was active. Even though the light level may not have been on for the first full hour, it will all average out. The hour counter is checked at 91 to see if twelve hours have accumulated in the hour counter variable. If twelve hours have not been seen (Ano≅at 91), the controller is again put into a sleep mode for one hour and the process begins anew at 85. If the counter indicates the plant has received twelve hours of light, one of the two outputs for the motor will be pulsed for a preset time period as shown by a yes output from 93 to 95. If the clockwise direction was selected, the counter for clockwise motor cycles will be incremented one and the hour counter reset to zero as shown at 95. If the clockwise count has reached 3 (CW=0) at 97, then the counterclockwise counter is reset (CCW=3) and the counterclockwise output is selected at 99. The operation returns to the main loop beginning at 85 and the controller is again put into a sleep mode for one hour. The process begins again at 85, but this time after the elapse of twelve hours of growth promoting light, CW=0 at 93 and the operation transitions to the right hand column where the motor is run counterclockwise at 101 and the operation proceeds much as described for clockwise motor energization.

What is claimed is:

1. A method of suspending a plant to distribute light from a source around the plant to ensure the application of uniform growth promoting light about the entire periphery of the plant, comprising the steps of:

suspending a motor driven plant hanger from a fixed elevated member;

suspending the plant from beneath the plant hanger;

sensing for the intensity of growth promoting light;

periodically incrementing the angular position of the plant relative to the plant hanger;

suspending periodic incrementation when the sensed light intensity falls below a predetermined threshold;

resuming periodic incrementation when the sensed light intensity exceeds the predetermined threshold;

summing the angular increments; and reversing the angular sense of the periodic increments when the sum of angular increments reaches a predetermined value.

2. The method of suspending a plant according to claim 1, wherein the steps of summing and reversing include initializing a counter with a desired number of angular incrementations, decrementing the counter by one each time the angular position of the plant is incremented and reversing the angular sense of the periodic angular increments when the counter reaches zero.

3. The method of suspending a plant according to claim 1, wherein the predetermined value is on the order of one complete revolution.

4. The method of suspending a plant according to claim 1, wherein the step of periodically incrementing comprises rotating of the plant a minimum of 15 degrees every twelve hours of sensed growth promoting light.

5. The method of suspending a plant according to claim 1, wherein the step of sensing includes periodically enabling a light intensity comparison circuit for a short time interval, and disabling the light intensity comparison circuit for a longer time interval between an enabled time interval and a successive enabled time interval, whereby the light intensity comparison circuit spends most of the time in a current conserving sleep mode.

6. The method of suspending a plant according to claim 1, including the additional step of commencing the summing anew each time the angular sense of the periodic increments is reversed.

* * * * *